United States Patent [19]

Nakanishi et al.

[11] Patent Number: 4,553,138

[45] Date of Patent: Nov. 12, 1985

[54] FIRE ALARM SYSTEM

[76] Inventors: Yoshitaka Nakanishi, 12-9, Yawata 5-chome; Hiroshi Nakanishi, 16-18, Yawata 6-chome, both of Ichikawa-shi, Chiba-ken; Takashi Nakanishi, 1-11, Kandaizumi-cho, Chiyoda-ku, Tokyo, all of Japan

[21] Appl. No.: 360,907

[22] Filed: Mar. 23, 1982

[30] Foreign Application Priority Data

Sep. 28, 1981 [JP] Japan ..... 56-152227

[51] Int. Cl.[4] ..... G08B 17/00; G08B 25/00

[52] U.S. Cl. ..... 340/584; 340/407

[58] Field of Search ..... 340/584, 407, 691

[56] References Cited

U.S. PATENT DOCUMENTS

| | | | |
|---|---|---|---|
| 2,886,804 | 5/1959 | Behrendt | 340/584 |
| 3,122,731 | 2/1964 | Hutchison | 340/407 X |
| 3,651,330 | 3/1972 | Hayes | 340/584 X |
| 3,760,397 | 9/1973 | Taggert | 340/584 X |
| 3,872,459 | 3/1975 | Curtis | 340/584 X |
| 3,914,692 | 10/1975 | Seaborn, Jr. | 340/407 X |
| 3,932,849 | 1/1976 | Welch | 340/586 |
| 3,984,825 | 10/1976 | Fujita | 340/691 X |
| 4,148,019 | 4/1979 | Durkee | 340/584 X |
| 4,255,746 | 3/1981 | Johnson et al. | 340/584 X |
| 4,315,256 | 2/1982 | Dennis | 340/584 X |
| 4,380,759 | 4/1983 | Sulkoski et al. | 340/407 |
| 4,388,617 | 6/1983 | Nakanishi et al. | 340/584 X |
| 4,410,884 | 10/1983 | Heiland | 340/691 X |
| 4,446,454 | 5/1984 | Pyle | 340/531 X |

FOREIGN PATENT DOCUMENTS

| | | | |
|---|---|---|---|
| 128209 | 4/1901 | Fed. Rep. of Germany | 340/407 |
| 2220409 | 1/1973 | Fed. Rep. of Germany | 340/407 |
| 2366649 | 6/1978 | France | 340/584 |
| 2395559 | 2/1979 | France | 340/407 |
| 36498 | 3/1977 | Japan | 340/584 |
| 75279 | 6/1977 | Japan | 340/584 |
| 1054975 | 1/1967 | United Kingdom | 340/584 |
| 563684 | 6/1977 | U.S.S.R. | 340/584 |

OTHER PUBLICATIONS

"SRS 150 A New Central Station for Complex Fire Protections Systems"; *Siemens Review,* vol. 43, No. 8, pp. 351–353; Aug. 1976; W. Stoib.

*Primary Examiner*—Stewart J. Levy
*Assistant Examiner*—Tom Noland

[57] ABSTRACT

A system for detecting an outbreak of fire, for giving an audible alarm therefore as well as provided with a tactile alarm for disabled persons. This system comprises a main body to be attached to the ceiling, the wall and other structures, and a switch box to be provided at a position apart from the main body. The main body includes a fire sensing element for sensing an outbreak of fire, and an alarm to make an alarm sound based on a detection signal of the fire sensing element. The switch box includes a control switch capable of directly actuating the alarm. The switch box is further provided with a vibrating-type buzzer for vibrating the switch box so that a deaf or disabled person will be able to confirm the actuation of the alarm when it is actuated.

5 Claims, 8 Drawing Figures

FIRE ALARM SYSTEM

BACKGROUND OF THE INVENTION

1. Field of the Invention

This invention relates to a fire alarm system having an audible alarm function, and more particularly to a system which will protect disabled persons, sick persons, bedridden old persons, and other persons having handicapped body from fire so as to enable these persons to make correct report whenever they want to get in touch with any other person urgently.

2. Prior Art

Those persons, who are in difficulty to walk, move freely, see, hear and speak, cannot simply make any matter known to others, even when they find out any unusual situation, such as breakout of fire, intrusion of robber and the like. Consequently, the detection thereof becomes too late which may result in the spread of fire, and the accident of death by fire and the injury from robber and burglar. Those patients in a hospital can get a doctor or a nurse by pushing a switch near the bed, however, in case of bedridden old persons at their home, they cannot ask for help by calling others such as when their conditions took a sudden change for the worse, because there is no such a device at home. Further, such a device is used that will produce alarm sound or calling out sound by means of a push-button switch, however, those who are hard of hearing cannot actually hear the alarm sound even though they push a push-button switch. And, even though an unusual situation is made known to any person by means of a flashing light, it cannot be seen by those having difficulty in eyesight. Therefore, those persons who have difficulty in hearing and eyesight cannot confirm whether correct alarm sound or calling out sound is produced, so that they are very uneasy.

SUMMARY OF THE INVENTION

An object of this invention is to provide a fire alarm system which is to be set up at a house of the disabled person, of those having difficulty in eyesight, hearing and speaking, of the bedridden old persons and the like, and which is able to detect fire and to produce alarm as well as to produce an alarm outside of rooms and of the house, thus to make the outbreak of unusual situation known to the neighborhood.

Another object of this invention is to provide a system which can surely confirm that an alarm informing the outbreak of unusual situation is correctly produced, by means of the vibration transmitted through the body of persons having difficulty in their eyesight and hearing.

DESCRIPTION OF THE PREFERRED EMBODIMENTS

Figure 1:
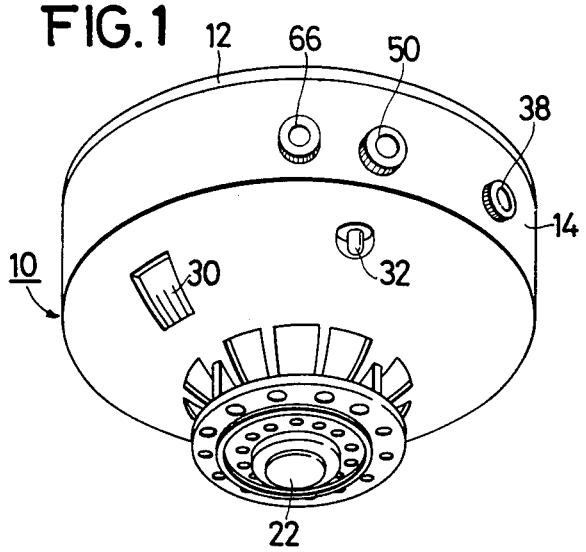
FIG. 1 is a perspective view of the main body of a fire alarm system provided with an alarm function according to this invention.
Figure 2:
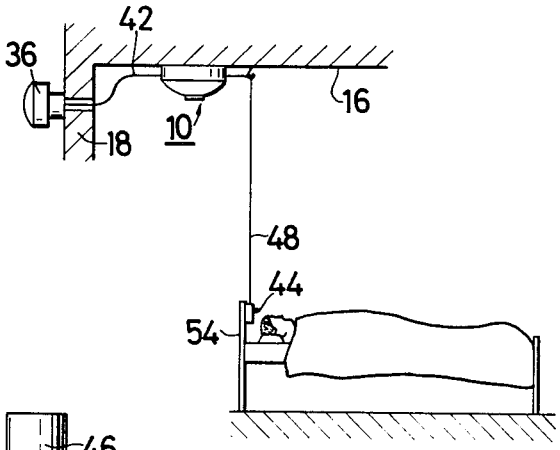
FIG. 2 is a side view showing a mode of use of the system according to this invention.

In FIG. 1, the main body 10 includes a stationary body 12 and a removable body 14, and attached to a place sensitive to hot air current caused by a fire of ceiling 16, wall 18 and other structures, by means of wood screws or double sided adhesive tapes. On the removable body is provided with an alarm means for producing alarm sound and a fire sensing means for sensing fire.

Figure 3:
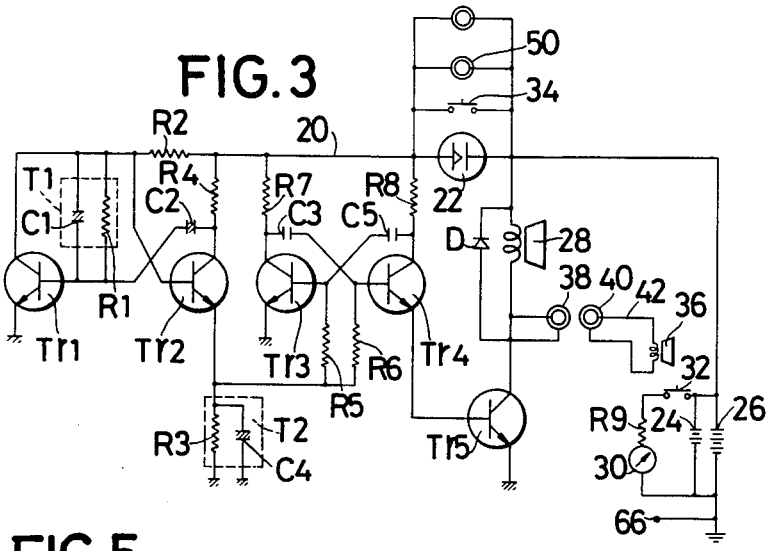
FIG. 3 is an electric circuit of the alarm means according to this invention.

As an alarm means, those of various structures may be adopted. In FIG. 3, an example of an electric circuit for an alarm means is shown. The alarm means comprises an oscillating circuit, a control circuit for intermittently controlling the operation of the oscillating circuit, a fire detection element for controlling the above circuit so as to operate at the time of a fire, an amplifier for amplifying an output signal of the oscillating circuit and a speaker for converting the signal amplified by means of the amplifier into the acoustic alarm.

In the oscillating circuit, an astable multi-vibrator including transistors Tr3 and Tr4 is adopted. The collector of the transistor Tr3 and that of the transistor Tr4 are connected to a lead 20 which is the common voltage supply line, through respective resistors R7 and R8. Further, the collector of the transistor Tr3 is coupled to the base of the transistor Tr4 through the capacitor C3. The collector of the transistor Tr4 is coupled to the base of the transistor Tr3 through the capacitor C5. The emitter of the transistor Tr3 is directly grounded. The emitter of the transistor Tr4 is connected to the base of the transistor Tr5 as explained below. This astable multivibrator produces an audible frequency signal of, for example, about 700 Hz. On the other hand, a control circuit for intermittently controlling the operation of the astable multi-vibrator includes transistors Tr1 and Tr2. The emitter of the transistor Tr2 is grounded through a time constant circuit T2 consisting of a resistance R3 and capacitor C4 and connected to the bases of the transistors Tr3 and Tr4 through resistances R5, R6 respectively. The base of the transistor Tr2 is connected to the collector of the transistor Tr1 and then to the lead 20 through a common resistor R2. The collector of the transistor Tr2 is connected to the lead 20 through the resistance R4 and then to the base of the transistor Tr1 through the capacitor C2. Between the base and the collector of the transistor Tr1, a time constant circuit T1 consisting of a resistance R1 and a capacitor C1 is connected. The emitter of the transistor Tr1 is directly grounded. In the fire sensing means a bimetal system fire detection element 22 is adopted. The fire detection element is connected between the lead and the positive terminals of batteries 24 and 26 which are power sources provided within the main body. The fire detection element may be a thermister, a ballister or some other semiconductor element.

The amplifier circuit consists of a transistor Tr5. The collector of the transistor Tr5 is connected to the positive terminals of the batteries as the power source through the speaker 28. The negative terminals of the batteries are grounded. The base of the transistor Tr5 is connected to the emitter of the transistor Tr4 as mentioned above.

When a fire is detected by means of the fire detection element, a current is supplied to the astable multivibrator and the control circuit from the battery. When a voltage is applied to the base of the transistor Tr2 through the resistance R2, the transistor Tr2 becomes conductive. The capacitors C1 and C2 are gradually charged through the resistance R4. When along with the charge of the capacitors, the base voltage of the transistor Tr1 becomes higher than the threshold level, the transistor Tr1 is brought into the conductive state. As the result, the transistor Tr2 is cut off. The capacitor C4 is sufficiently charged before the transistor Tr2 becomes conductive and then cut off. When the transistor Tr2 is cut off, the capacitor C4 is gradually discharged through the resistance R3, whereby the terminal voltage across the capacitor C4 is gradually decreased. When it reaches a certain determined level, the astable multivibrator starts to oscillate. During this time, the capacitor C1 is discharged through the resistance R1, while the transistor Tr1 is cut off after the lapse of a certain determined time. As the result, a voltage is again applied to the base of the transistor Tr2 through the resistance R2, so that the transistor Tr2 is brought into the conductive state. Thus, the terminal voltage across the resistor R3 increases and the astable multivibrator stops the operation. The operation is repeated while the fire detection element is detecting the fire. The intermittent oscillation signals from the astable multivibrator are amplified by means of the transistor Tr5 and produced as the acoustic alarm from the speaker 28. The oscillation frequency of the astable multivibrator is determined by the time constant of the resistance R6 and the capacitor C3 and that of the resistance R5 and the capacitor C5. When the time constant of the resistance R6 and the capacitor C3 is chosen differently from that of the resistance R5 and the capacitor C5, the tones of the acoustic alarm are conveniently made different. Further, the emitter of the transistor Tr4 is grounded through the base of the transistor Tr5, so that it is advantageous if the value of the collector resistor R8 of the transistor Tr4 is chosen somewhat smaller than that of the collector resistor R7 of the transistor Tr3 in such a manner that the voltage drop between the base and the emitter of the transistor Tr5 is compensated. And, a diode D connected in parallel with a driving coil of the speaker will protect the transistor Tr5.

Two batteries are connected in parallel to each other in order to avoid a drop in terminal voltage of the batteries. There is provided a check means consisting of an ammeter 30 and a voltage dividing resistance R9 and a switch 32 connected in series with the batteries. Whenever the switch is closed, the battery voltage can be checked by means of the ammeter. Further, when checking whether each circuit of the main body is operating normally, a switch 34 is connected in parallel to the fire detection element.

The electrical circuit consists of transistors, resistances and capacitors in a discrete manner, however,it may be formed with field-effect transistor (FET) or linear integrated circuits so as to effect the same functions as mentioned above.

There is an external speaker 36 which serves as other alarm means in series with the above speaker, and is connected to a jack 38 of the main body through a jack 40 and a wire 42. The external speaker is set up outside of a room or at the exterior of a house, preferably those of waterproof type are used. And, as shown in the drawing, when the external speaker is connected in series with the speaker of the main body, the amount of consumption of the batteries will become smaller compared with the case when it is connected in parallel with that of main body, so that it can be sounded for a long time.

Figure 4:
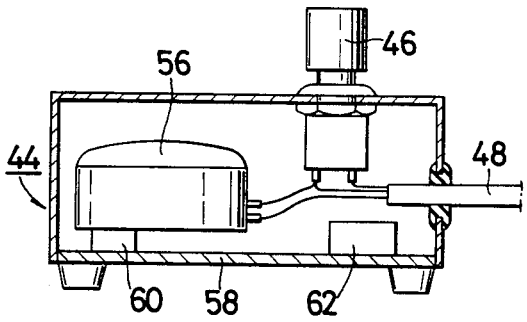
FIG. 4 is a sectional view of a switch box according to this invention.

Apart from the main body, there is a switch box 44, on which a control switch 46 is provided so as to operate the alarm means directly (FIG. 4). The control switch is connected in parallel with the fire detection element of the alarm means, when a jack 52 is connected to a jack 50 provided on the main body. Preferably the control switch is of a push-button switch with a lock. This push-button switch with a lock will operate in such a manner that when the switch button is once pushed, it will remain in a locked state and when it is pushed again its unlocked state is restored. Therefore, when a disabled person once pushes the switch button, a locked state is maintained without continuous pushing of the button, which is especially convenient to those persons. The switch box provided with legs made of rubber on its back may be rested on a table or the like, attached thereon with double sided adhesive tapes or screws, and hung down with suitable fastness.

If the switch box is placed near the pillow or the like of a disabled person confined to a bed 54, he can produce an alarm sound through respective speakers provided on the main body, outside of the room or the exterior of the house, by pushing (closing) the control switch, whenever he want to call for help.

Figure 5:
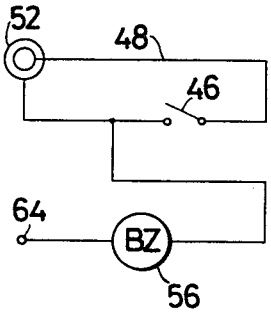
FIG. 5 is an electric circuit for the switch box shown in FIG. 4.

In FIGS. 4 and 5, there is shown a system provided with an vibration means controlled by a control switch 46, within a switch box 44. As the vibration means, for example, an electromagnetic vibrator, can be used that will mechanically vibrate when electricity is supplied. And a vibrating-type buzzer 56 is used in the drawing. The buzzer is attached to a base plate 58 in the switch box, preferably at one spot by means of a support 60, so that when the switch is closed, vibration sound is produced as well as the whole switch box is vibrated. Therefore, the vibration can be transmitted to those persons having difficulty in hearing or eyesight through the switch box, thus can surely make them known that an alarm sound is producing. If the weight of a switch box is too small, a suitable weight 62 may be attached. Further, a jack 64 is connected to a jack 66 which is connected to the negative side of the batteries.

Figure 6:
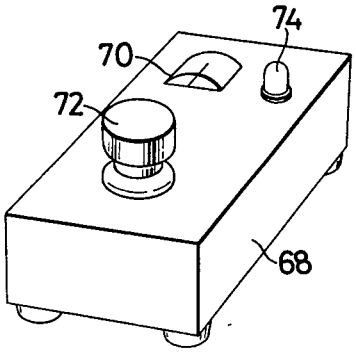
FIG. 6 is a perspective view of another switch box according to this invention.
Figure 7:
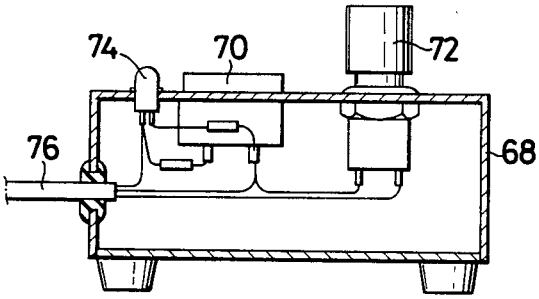
FIG. 7 is a sectional view of the switch box shown in FIG. 6.
Figure 8:
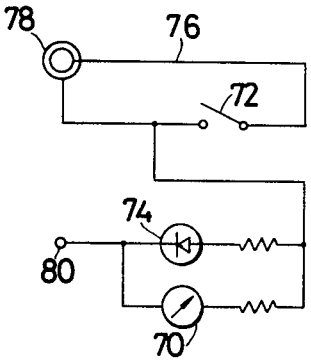
FIG. 8 is an electric circuit for the switch box shown in FIG. 6.

In FIGS. 6 to 8, a device is shown, which is formed in such a manner that a battery meter 70 and other alarm means are provided in a switch box 68 and these are controlled by means of a control switch 72. As the alarm means, vibration means such as a speaker, a buzzer of the like may be used. In the drawing a lamp, concretely a luminous diode 74, is provided in parallel with the meter so as to be connected to the jack 50 of the main body through a wire 76 and a jack 78. When the control switch is closed, residual charge of the batteries can be checked by means of the deflection of needle and/or the brightness of the luminous diode, the persons having difficulty in hearing can confirm visually that an alarm sound is being produced. On the end of the meter or the like is connected to the jack 66 which is connected to the negative side of the batteries by means of a jack 80.

Further, by means of the jack of the main body, branch devices may be connected, each of which having a fire detection element and being provided at remote places from the main body, for example at neighboring rooms or at different rooms (not shown in the drawing).

What is claimed is:

1. A fire alarm system comprising a first unit mounted on a wall or ceiling surface of a room of a building and a second unit located more conveniently to an occupant of the room, said first unit comprising fire sensing means, acoustic alarm means controlled by said fire sensing means, and power supply means for supplying power to said fire sensing means and said alarm means, and said second unit comprising a switch box, an on-off control switch in said switch box and electrically connected with said alarm means of said first unit additionally to control said alarm means, and vibration means provided in said switchbox and also directly actuated by said control switch, said vibration means comprising a vibration type buzzer mounted in said switch box and operable to produce an audible alarm signal and to vibrate said switch box to provide a tactile signal when actuated.

2. A fire alarm system according to claim 1, in which said control switch is of a locking type, which when actuated to "on" position remains in "on" position until again actuated.

3. A fire alarm system comprising a first unit mounted on a wall or ceiling surface of a room of a building and a second unit located more conveniently to an occupant of the room, said first unit comprising fire sensing means, acoustic alarm means controlled by said fire sensing means, power supply means for said fire sensing means and said alarm means and a first housing for said fire sensing means, said alarm means and said power supply means, said first housing comprising a stationary part fixed to said surface and a removable part, and said sceond unit comprising on-off switch means, operable by an occupant of the room, signal means controlled by said switch means, and a second housing for said switch means and said signal means, said signal means comprising a vibration-type buzzer mounted in said second housing and operable when actuated both to produce an audible signal and to vibrate said second housing to provide a tactile signal, and means electrically connecting said second unit with said first unit for control of said alarm means by said switch means.

4. A fire alarm system according to claim 3, further comprising second alarm means mounted outside said building, and means electrically connecting said second alarm means with said first unit and with said second unit for control of said second alarm means by said fire sensing means and by said switch means.

5. A fire alarm system according to claim 3, in which said alarm means of said first unit comprises an astable multivibrator means for producing an audible frequency signal, control circuit means for controlling said astable multivibrator to operate intermittently when a signal is received from said fire sensing means, amplifying means for amplifying an output of said astable multivibrator and speaker means for converting an amplified signal from said amplifying means into sound.

* * * * *